US006619346B2

(12) United States Patent
Havumaki et al.

(10) Patent No.: US 6,619,346 B2
(45) Date of Patent: Sep. 16, 2003

(54) DEBARKING MACHINE

(75) Inventors: Jouni Havumaki, Vaaksy (FI); Pekka Kokko, Hollola (FI); Bruce Kirkpatrick, Lachine (CA)

(73) Assignee: Andritz Oy, Hollola (FI)

( * ) Notice: Subject to any disclaimer, the term of this patent is extended or adjusted under 35 U.S.C. 154(b) by 0 days.

(21) Appl. No.: 10/121,159

(22) Filed: Apr. 11, 2002

(65) Prior Publication Data

US 2002/0170627 A1 Nov. 21, 2002

Related U.S. Application Data

(60) Provisional application No. 60/283,620, filed on Apr. 13, 2001.

(51) Int. Cl.[7] ..... B27L 1/00

(52) U.S. Cl. ..... 144/208.9; 144/208.1; 144/341

(58) Field of Search ..... 144/208.1, 208.4, 144/208.9, 341, 242.1; 241/14, 24.2, 235, 236, 241

(56) References Cited

U.S. PATENT DOCUMENTS

| | | | | |
|---|---|---|---|---|
| 3,228,440 A | | 1/1966 | Ferrabee | 144/208 |
| 4,691,750 A | * | 9/1987 | Nakajima | 144/341 |
| 5,394,912 A | | 3/1995 | Hume | 144/208 R |
| 5,673,865 A | * | 10/1997 | Stroulger | 144/341 |
| 6,360,796 B1 | * | 3/2002 | Oledal et al. | 144/341 |

FOREIGN PATENT DOCUMENTS

| | | |
|---|---|---|
| FI | 852752 | 1/1986 |
| WO | WO 98/01271 | 7/1997 |

OTHER PUBLICATIONS

English Abstract of DE3524837, Feb. 1986.

Search Report from Finland.

International Search Report corresponding to International Application No. PCT/FI20/00124 dated Jun. 27, 2002.

* cited by examiner

*Primary Examiner*—W. Donald Bray
(74) *Attorney, Agent, or Firm*—Alix, Yale & Ristas, LLP

(57) ABSTRACT

The invention relates to a debarking machine for the debarking of logs and for the expulsion of at least some of the removed bark from a wood flow passing through the debarking machine. The debarking machine having a number of rotating debarking shafts extending parallel to an advancing direction (A) of the logs to be fed therethrough. The debarking shafts are provided with a number of teeth adapted to strip bark off the logs transversely to the lengthwise direction of the logs and at the same time to convey the logs transversely relative to said shafts. The shafts, together with the teeth thereof constitute at least a section of a support surface upon which the logs travel through the debarking machine. For feeding the logs into the debarking machine, its admission end is provided with a conveyor adapted to positively feed the logs through an opening in the admission end of the debarking machine. The feed rate and feed force of the conveyor are preferably regulated.

20 Claims, 2 Drawing Sheets

DEBARKING MACHINE

CROSS REFERENCE TO RELATED APPLICATIONS

This application claims the benefit of U.S. Provisional Application No. 60/283,620, filed Apr. 13, 2001.

BACKGROUND OF THE INVENTION

1. Field of the Invention

The invention relates to a debarking machine for the preliminary debarking of logs prior to a separately performed final debarking, and more specifically to a debarking machine that includes a conveyor to store and feed logs.

2. Description of the Related Art

Debarking machines are disclosed e.g. in U.S. Pat. Nos. 4,685,498 and 5,394,912. A problem with the type of prior art debarking machines described in these patents is how to control the time that the logs to be debarked dwell or reside in the debarking machine. Excessive dwell time results in wood loss and, on the other hand, insufficient dwell time leaves too much bark on the logs. Dwell time should be readily changeable, depending e.g. on the type of wood to be barked and whether the wood is frozen or unfrozen.

Another drawback in the prior known solutions is that, due to the debarking machine having a closed end, the logs must be supplied into the debarking machine from above, i.e. the logs must be first hoisted up and then lowered or dropped into the debarking machine.

SUMMARY OF THE INVENTION

To eliminate these drawbacks, there is provided a debarking machine with an admission end provided with an opening for feeding logs into the debarking machine in a direction which corresponds to the advancing direction of the logs within the debarking machine itself. For feeding the logs, the debarking machine has its admission end provided with a conveyor adapted to positively feed the logs through the opening onto a lower portion of the chute of the debarking machine. Logs fed into the debarking machine displace logs previously fed in. By virtue of this arrangement, the rate of admission of logs into the debarking machine, as well as dwell time for logs in the debarking machine, can be readily controlled.

A debarking machine in accordance with the present invention may also be described as a debarking station in the path of a wood flow. Wood support surfaces extend above the conveyor to form a chute for supporting logs piled on the conveyor. This pile of logs forms a reservoir of wood to be fed into the debarking station. The chute has a similar cross-sectional shape to a chute defined by support surfaces in the debarking station and is aligned with the debarking station such that wood on the conveyor moves straight into the debarking station. The invention transforms what was a batch debarking process in the prior art into a continuous process.

The advancement of logs through a debarking machine can be made totally dependent upon the positive feed of a conveyor functioning as a supply system for the debarking machine. Another way of designing a debarking machine is of course that the debarking machine itself provides either an encouraging or discouraging effect on the advancement of logs, e.g., by adjusting the inclination of the debarking machine as is known in the art.

The conveyor has a feed rate and, if necessary, also a feed force that can be regulated. At its simplest, the feed rate regulation may comprise a mere switch for switching the conveyor on or off. In one preferred embodiment of the invention, the conveyor is adapted to store logs to be fed into the debarking machine. Thus, logs can be supplied onto the conveyor at highly irregular intervals while maintaining a constant wood flow into the debarking machine itself. Another influencing factor in terms of the operation of a debarking machine is the thickness of a layer of logs supplied onto the conveyor.

The maximum distance of an active conveyor section from the admission end of a debarking machine is preferably less than the average length of logs to be barked in the debarking machine. Proper selection of this distance in accordance with the average length of a log ensures reliable feeding of logs by means of the conveyor. For the same reason, the conveyor has its feeding direction and profile arranged in view of allowing also a free movement upstream of a debarking machine.

A guide element is preferably provided between the conveyor and the debarking machine. The guide element comprising one or more guide surfaces for delivering logs into the debarking machine. To ensure proper guidance for the logs, the guide surface of the guide element is preferably designed to have a width transverse to the feed direction that is substantially equal to the cross-sectional width of the admission end opening at a position corresponding to the log entry point.

The opening provided in the admission end of the debarking machine is configured substantially equal to the size and shape of a chute formed by the support surfaces present in the debarking machine, upon which the logs to be processed travel through the debarking machine. The conveyor chute and debarker chute form a substantially continuous trough.

BRIEF DESCRIPTION OF THE DRAWINGS

The invention will now be described in more detail with reference to the accompanying drawings, in which.

DETAILED DESCRIPTION OF THE PREFERRED EMBODIMENT

Figure 2:
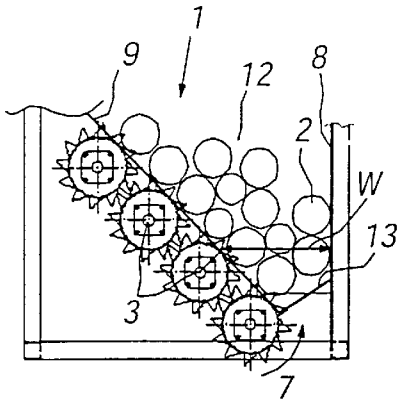
FIG. 2 is a sectional view through the debarking machine of FIG. 1, taken along a line 2—2 thereof.
Figure 1:
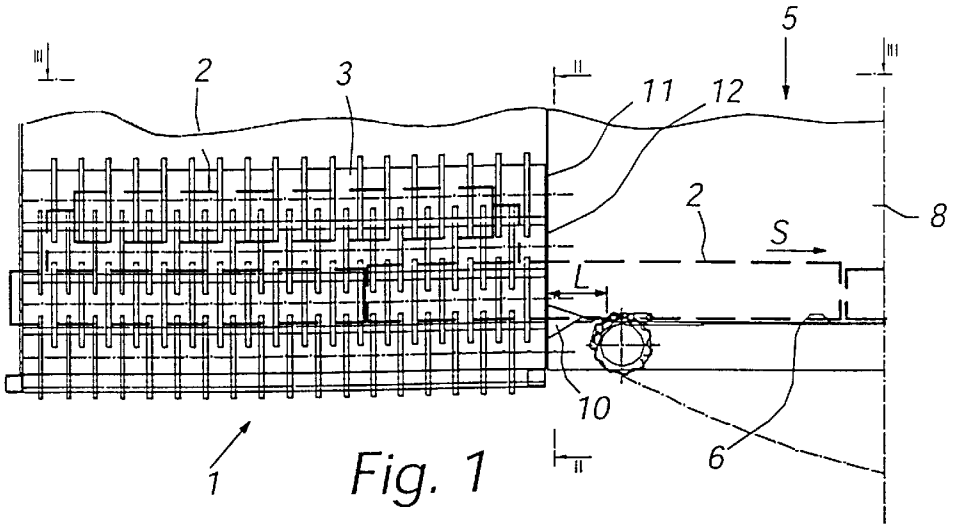
FIG. 1 is a schematic side view of a junction between a debarking machine and a feeding mechanism in accordance with the present invention.
Figure 3:
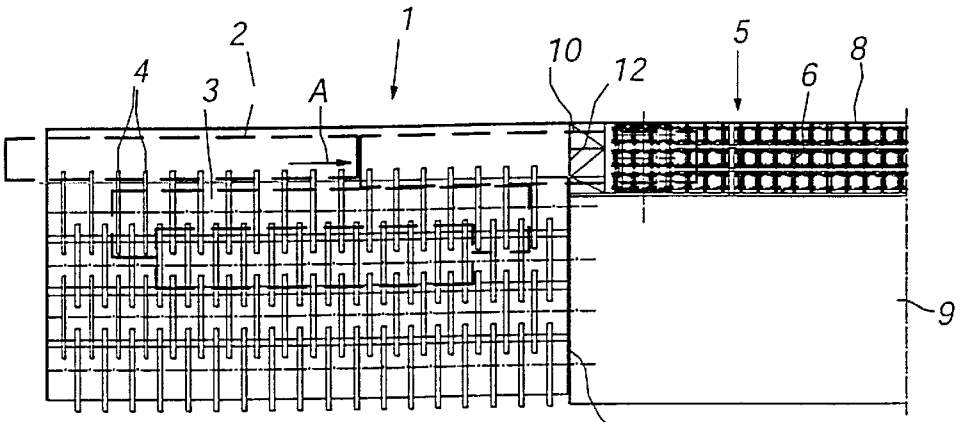
FIG. 3 is a schematic top view of the junction between the debarking machine and a feeding mechanism of FIG. 1.

FIGS. 1–3 depict a debarking machine 1 which is intended for pretreatment debarking of logs 2 before a separately performed final barking and for the expulsion of at least some of the removed barks from a wood flow passing through the debarking machine.

The debarking machine 1 is provided with a number of debarking shafts 3, which extend parallel to an advancing direction A of the logs 2 to be fed therethrough and which are rotatable in the direction of an arrow 12 by means of a motor and drive elements, not shown.

The debarking shafts 3 are provided with a number of teeth 4 extending beyond the circumferential surface of the shaft 3, which are adapted to strip bark off the logs 2 transversely to the lengthwise direction of the logs. Rotation of the debarking shafts 3 also causes the logs to move transversely relative to the debarking shafts 3, or up the inclined plane formed by the shafts 3. The logs 2 are held against the shafts and teeth 4 by gravity and the weight of other logs. Logs 2 in the debarking machine 1 circulate up the inclined plane formed by the shafts 3 and tumble back down the inclined plane on top of other logs. This tumbling acts in concert with the rotating teeth 4 to loosen bark from the logs 2.

The debarking shafts 3, together with their teeth 4, constitute a section of a support surface upon which the logs 2 to be processed travel through the debarking machine 1. The illustrated example includes four debarking shafts 3, which are fitted relative to each other so as to provide an inclined plane. The support surfaces are solid surfaces, which are designed to form, together with the support surface constituted by the debarking shafts 3, a chute extending the length of the debarking machine 1. The chute may have an open top or it may be covered.

The debarking machine 1 has its admission end 5 provided with an opening 6 for feeding the logs 2 into the debarking machine 1 in a direction S, which is consistent with the advancing direction A for the logs in the debarking machine 1 itself. The opening 6 can also be understood as the removal of the end of the chute defined by the support surfaces of the debarking machine 1. Below the support surfaces 10,13, the admission end of the debarking machine is closed by a panel 9. The opening 6 has substantially the same shape as the chute when the opening 6 and chute are viewed from the admission end, as shown in FIG. 2. This configuration provides for unimpeded wood flow from the conveyor 7 into the debarking machine 1.

The admission end 5 of the debarking machine 1 is provided with a conveyor 7. The conveyor 7, which can be any conventional type of conveyor, for example a chain conveyor, is adapted to positively feed the logs 2 through the opening 6 and into the chute of the debarking machine. The conveyor 7 is preferably arranged to feed logs 2 into the bottom portion of the chute of the debarking machine 1. The conveyor 7 has its feed rate and/or feed force adapted to be regulated in a per se known manner.

Advancement of the logs 2 through the debarking machine 1 is best discussed with reference to FIGS. 2 and 3. When the conveyor 7 is pushing a log 2 through the opening 6, said log will push another log out the discharge end of the debarking machine. Several logs 2 may be fed simultaneously in and therefore several logs will be pushed out at the same time. The discharge end may be equipped with a conveyor that helps to pull the logs out or a conveyor that simply feeds the logs forwards. Normally the logs will not move in direction A except those logs that are pushed by the conveyor 7. The admission rate of logs 2 is controlled by varying the feed rate and/or feed force of the conveyor 7. A higher feed rate will displace logs from the debarking machine 1 at a faster rate, reducing the dwell time of logs in the machine.

In a special case the debarking machine 1 may have an inclination downwards from the admission end 5 to the opposite discharge end as is known in the art. In that case the logs may move also without the pushing force of the conveyor 7.

The conveyor 7 may be adapted to function as a reservoir for the logs 2 to be fed into the debarking machine 1. FIG. 3 illustrates that side panels 10, 11 are arranged to form a chute projecting above the conveyor 7. Logs 2 may be piled on the conveyor 7, from which they are fed into the debarking machine 1. The logs piled between the side panels 10, 11 of the inlet conveyor 7 may be fed through the opening 6 one by one or several logs at the same time. The amount of logs or the thickness of a layer of logs to be fed at a time may be controlled e.g. by adjustable stops (not shown).

The maximum distance for an active section of the conveyor 7 from the admission end of the debarking machine 1 is preferably no more than a distance L, which is less than the average length of logs to be treated in the debarking machine 1 as can be seen from FIGS. 1 and 3.

The feeding direction S of the conveyor 7 is at least roughly the same as the wood advancing direction A within the debarking machine 1. The support surface of the conveyor 7 has a width (measured transverse to the feed direction S) which is designed to be substantially equal to the width W of the chute between support surfaces where the logs are fed through the admission end opening 6.

Between the conveyor 7 and debarking machine 1 is provided a guide element 8, comprising one or more guide surfaces for guiding the logs 2 into the debarking machine 1. The guide element 8 has a guide surface designed also to have a width substantially equal to the width W of the chute.

Figure 4:
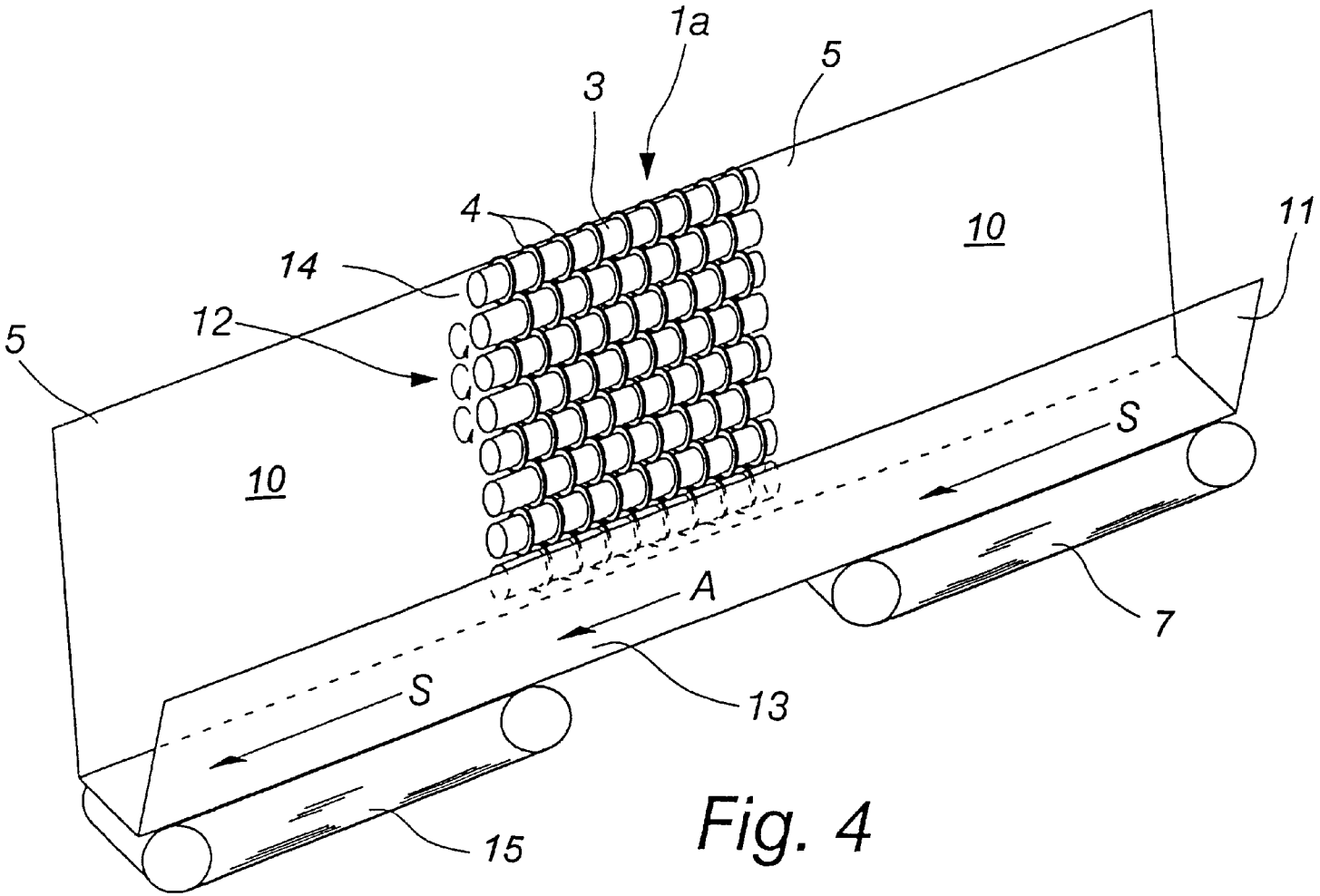
FIG. 4 is an overhead perspective view of one possible arrangement of a debarking machine equipped with input and output conveyors and arranged as a continuous trough in accordance with the present invention.

FIG. 4 is an overhead perspective view of one possible debarking machine 1*a* in accordance with the present invention. The debarking machine 1*a* is configured as an open-ended trough defined by the inclined plane of the debarking shafts 3, the bottom plate 13 and side panel 11. The debarking machine 1*a* is positioned between a feed conveyor 7 and a discharge conveyor 15. Both conveyors 7, 15 are configured to move logs in direction S which coincides with the direction A of wood movement through the debarking machine 1*a*. Side panels 10, 11 extending above the conveyors 7, 15 are essentially extensions of the chute formed by the support surfaces of the debarking machine 1*a*. Logs fed by conveyor 7 are preliminarily debarked as they pass through the debarking machine 1*a*. The extent of this preliminary debarking is dependant upon the dwell time of log in the debarking machine 1*a*. Dwell time is controlled by the feed rates of the conveyors 7, 15 as discussed above.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A debarking machine for pretreatment of logs before a separately performed final barking and for the expulsion of at least some of the removed barks from a wood flow passing through the debarking machine, said debarking machine comprising a number of rotatable debarking shafts extending parallel to an advancing direction (A) of the logs to be fed therethrough, which are provided with a number of teeth extending beyond a circumferential surface of said shafts and adapted to strip bark off the logs transversely to a lengthwise direction of the logs and at the same time to convey the logs transversely relative to said shafts, and said shafts, together with the teeth thereof, being adapted to constitute at least a section of a support surface, upon which the logs travel through the debarking machine, characterized in that for feeding the logs into the debarking machine, an admission end of the debarking machine includes an opening at a height corresponding to a height of a lower section of said support surface and is provided with a conveyor to positively feed the logs through said opening onto said support surface lower section and that a feeding direction (S) of the conveyor is substantially parallel to the advancing direction (A) of logs within the debarking machine.

2. A debarking machine as set forth in claim 1, characterized in that the conveyor has a variable feed rate and/or a variable feed force.

3. A debarking machine as set forth in claim 1, characterized in that the conveyor functions as a storage for the logs to be fed into the debarking machine.

4. A debarking machine as set forth in claim 1, characterized in that a maximum distance (L) for the conveyor from the admission end of the debarking machine is preferably no more than an average length of the logs to be barked in the debarking machine.

5. A debarking machine as set forth in claim 1, characterized in that the conveyor, used for guiding the logs, has a lateral width that is substantially equal to a corresponding lateral dimension of the support surface lower portion.

6. A debarking machine as set forth in claim 1, characterized in that between the conveyor and the debarking machine is provided a guide element, comprising one or more guide surfaces for guiding the logs into the debarking machine.

7. A debarking machine as set forth in claim 6, characterized in that the guide element has a guide surface, used for guiding the logs, said guide surface having a lateral dimension that is substantially equal to a corresponding lateral dimension of the support surface lower portion.

8. A debarking machine as set forth in claim 1, characterized in that the opening in the admission end of the debarking machine has a lower part and is dimensioned, at least in said lower part, to be equal to the size of a chute defined by the support surface.

9. A debarking machine for removing bark from logs having a length and advancing into said debarking machine in a first direction, said debarking machine comprising:

a plurality of rotatable debarking shafts extending substantially parallel to said first direction, each said shaft having a plurality of radially projecting teeth, said teeth comprising at least a portion of a support surface upon which the logs are supported;

a chute arranged around said plurality of debarking shafts, said chute comprising an end panel defining an opening, a front panel and a bottom panel extending between said front panel and said plurality of debarking shafts to define a lower portion of said chute; and a conveyor for feeding logs through said opening in said first direction, whereby said logs are fed into said chute lower portion.

10. The debarking machine of claim 9, wherein said conveyor has a log feed rate and feed force and said feed rate and/or feed force are variable.

11. The debarking machine of claim 9, wherein said conveyor is configured to store logs to be fed through said opening.

12. The debarking machine of claim 9, wherein the logs have an average length and said conveyor is spaced from said opening a distance less than the average length of the logs.

13. The debarking machine of claim 9, wherein said conveyor has a feed direction substantially parallel to said first direction.

14. The debarking machine of claim 9, wherein said bottom plate is inclined relative to said debarking shafts such that logs move toward said debarking shafts by force of gravity.

15. The debarking machine of claim 9, wherein said chute lower portion has a lateral dimension and said conveyor has a substantially equivalent corresponding lateral dimension measured transverse to said first direction.

16. The debarking machine of claim 9, comprising a guide element comprising one or more guide surfaces for guiding the logs from the conveyor into said opening.

17. The debarking machine of claim 16, wherein said opening, conveyor and guide element have substantially the same width measured transverse to said first direction.

18. A debarking station for debarking logs, said station comprising:

a longitudinally extending open ended debarking trough wherein at least part of the debarking trough is defined by a plurality of longitudinally extending rotatable debarking shafts, each debarking shaft equipped with a plurality of radially projection teeth;

a feed conveyor substantially parallel to said debarking trough and arranged to feed logs into a first open end of said debarking trough, wherein logs entering the first open end of said debarking trough longitudinally displace logs already present in the debarking trough by pushing them out a second open end of the debarking trough.

19. The debarking station of claim 18, wherein the feed conveyor is equipped with side panels to form a feed trough having substantially the same cross sectional configuration as the debarking trough.

20. The debarking station of claim 18, wherein the second end of the debarking station is provided with a discharge conveyor equipped with side panels to form a discharge chute having substantially the same cross sectional configuration as the debarking trough.

* * * * *